US011148162B2

(12) United States Patent
Qu et al.

(10) Patent No.: US 11,148,162 B2
(45) Date of Patent: Oct. 19, 2021

(54) FLUID MICRO-INJECTION DEVICE AND FLOW CHANNEL ASSEMBLY

(71) Applicant: CHANGZHOU MINGSEAL ROBOT TECHNOLOGY CO., LTD., Changzhou (CN)

(72) Inventors: Dongsheng Qu, Changzhou (CN); Jijiang Min, Changzhou (CN); Pei Sun, Changzhou (CN); Yangyang Mao, Changzhou (CN); Fuliang Gao, Changzhou (CN)

(73) Assignee: CHANGZHOU MINGSEAL ROBOT TECHNOLOGY CO., LTD., Changzhou (CN)

( * ) Notice: Subject to any disclaimer, the term of this patent is extended or adjusted under 35 U.S.C. 154(b) by 96 days.

(21) Appl. No.: 16/611,732

(22) PCT Filed: Jan. 22, 2018

(86) PCT No.: PCT/CN2018/073594

§ 371 (c)(1),
(2) Date: Nov. 7, 2019

(87) PCT Pub. No.: WO2018/205682

PCT Pub. Date: Nov. 15, 2018

(65) Prior Publication Data

US 2020/0101483 A1 Apr. 2, 2020

(30) Foreign Application Priority Data

May 8, 2017 (CN) ..... 201710319031.7
May 8, 2017 (CN) ..... 201720507094.0

(51) Int. Cl.
*B05B 15/65* (2018.01)
*B05B 1/30* (2006.01)

(52) U.S. Cl.
CPC ..... *B05B 15/65* (2018.02); *B05B 1/3046* (2013.01)

(58) Field of Classification Search
CPC ..... B05B 15/65; B05B 1/3046
(Continued)

(56) References Cited

U.S. PATENT DOCUMENTS 5,085,444 A 2/1992 Murakami et al.
7,017,913 B2 3/2006 Klenk et al.
(Continued)

FOREIGN PATENT DOCUMENTS

CN 1487225 4/2004
CN 101412011 4/2009
(Continued)

OTHER PUBLICATIONS

English translation of the International Search Report from corresponding PCT Appln. No. PCT/CN2018/073594, dated Apr. 19, 2018.

(Continued)

*Primary Examiner* — Steven J Ganey
(74) *Attorney, Agent, or Firm* — Grossman, Tucker, Perreault & Pfleger, PLLC

(57) ABSTRACT

A flow channel assembly (200) of a fluid micro-injection device have a fluid seat (210), a nozzle (220) and a fluid supply joint (230), the fluid seat (210) defines a fluid chamber (211) and a flow channel (212), which communicates with each other, the nozzle (220) is in communication with the fluid chamber (211), the movable member of the fluid micro-injection device movably passes through the fluid chamber (211) to open and close the nozzle (220), the fluid supply joint (230) communicates with the flow channel (212) to provide fluid to the nozzle (220) through the flow channel (212) and the fluid chamber (211).

19 Claims, 5 Drawing Sheets

(58) Field of Classification Search
USPC ..... 239/583, 585, 600, 584, 585.1
See application file for complete search history.

(56) References Cited

U.S. PATENT DOCUMENTS

| | | | | |
|---|---|---|---|---|
| 10,119,617 | B2 | 11/2018 | Kobayashi | |
| 10,234,037 | B2 | 3/2019 | Kobayashi et al. | |
| 2014/0299680 | A1* | 10/2014 | Muller | B05B 1/306 239/583 |

FOREIGN PATENT DOCUMENTS

| | | |
|---|---|---|
| CN | 201361599 | 12/2009 |
| CN | 202070458 | 12/2011 |
| CN | 104971840 | 10/2015 |
| CN | 205084915 | 3/2016 |
| CN | 107051794 | 8/2017 |
| CN | 206793958 | 12/2017 |
| CN | 206793976 | 12/2017 |
| CN | 207056869 | 3/2018 |
| CN | 207056870 | 3/2018 |
| CN | 207154025 | 3/2018 |
| DE | 1893773 | 5/1964 |
| EP | 1625892 | 2/2006 |
| FR | 1093095 | 4/1955 |
| GB | 683298 | 11/1952 |
| JP | 63-243538 | 10/1988 |
| JP | H03115774 | 5/1991 |
| KR | 101274225 | 6/2013 |
| KR | 101516082 | 4/2015 |
| KR | 20150038889 | 4/2015 |
| KR | 1020150085664 | 7/2015 |
| KR | 101586017 | 1/2016 |
| WO | 2016/021473 | 2/2016 |
| WO | 2016/076186 | 5/2016 |

OTHER PUBLICATIONS

English translation of First Office Action from corresponding Chinese Appln. No. 201710319031.7, dated Apr. 17, 2019.
English translation of the Written Opinion of the International Searching Authority from corresponding PCT Appln. No. PCT/CN2018/073594, dated Apr. 19, 2018.
English translation of Third Office Action from corresponding Chinese Appln. No. 201710319031.7, dated Sep. 28, 2020.
English translation of Request for the Submission of an Opinion from related Korean Appln. No. 10-2019-7017370 dated Dec. 1, 2020.
English translation of Second Office Action from corresponding Chinese Appln. No. 201710319031.7, dated Jun. 12, 2020.
English translation of Second Search Report from corresponding Chinese Appln. No. 201710319031.7, dated Jun. 4, 2020.
Grant of Patent from related Korean Appln. No. 10-2019-7017370 dated Jun. 16, 2021. English translation attached.

* cited by examiner

FLUID MICRO-INJECTION DEVICE AND FLOW CHANNEL ASSEMBLY

FIELD

The present disclosure relates to a flow channel assembly for a fluid micro-injection device and a fluid micro-injection device having the flow channel assembly.

BACKGROUND

The fluid flow channel of the existing fluid micro-injection device may have problems of closed flow channels, cumbersome cleaning, and complex assembly/disassembly of related accessories, resulting in low assembly efficiency, inconvenient assembly/disassembly or cleaning with high maintenance cost, and the assembly of the device may be time-consuming.

SUMMARY

The present disclosure may aim to solve at least one of technical problems existing in the art.

To this end, the present disclosure may provide a flow channel assembly of a fluid micro-injection device that may be easy for cleaning and simple for assembly.

The present disclosure may also provide a fluid micro-injecting device having the above-described flow channel assembly.

According to an embodiment of the first aspect of the present disclosure, a flow channel assembly of a fluid micro-injection device may comprise: a fluid seat defining a fluid chamber and a flow channel in communication with the fluid chamber therein; a nozzle disposed on the fluid seat and in communication with the fluid chamber, a movable member of the fluid micro-injection device movably passing through the fluid chamber to open and close the nozzle; and a fluid supply joint communicating with the flow channel to provide fluid to the nozzle through the flow channel and the fluid chamber.

As for the flow channel assembly of the fluid micro-injection device according to the embodiment of the present disclosure, the fluid chamber and the flow channel may be defined in the fluid seat, the nozzle on the fluid chamber may be opened and closed by the movable member, and the fluid supply joint may communicate with the fluid chamber through the flow channel. Thus, the flow channel assembly may have a simple structure, convenient for disassembly and assembly with low maintenance cost.

According to one embodiment of the present disclosure, the flow channel assembly may further comprise: an adapter defining a flow guiding passage therein. And the adapter may be connected to the fluid seat and the flow guiding passage may be in communication with the flow channel, the fluid supply joint may be disposed on the adapter and communicate with the flow guiding passage.

According to one embodiment of the present disclosure, seal rings may be respectively disposed between the adapter and the fluid supply joint and between the adapter and the fluid seat.

According to one embodiment of the present disclosure, the adapter and the fluid seat may be connected by a screw.

According to one embodiment of the present disclosure, the fluid seat may be provided with a first assembly ramp extending slantedly with respect to a horizontal direction, and the adapter may be provided with a second assembly ramp that fits with the first assembly ramp, the screw passes through the adapter and the fluid seat to compress the first assembly ramp and the second assembly ramp.

According to one embodiment of the present disclosure, the first assembly ramp may be provided with a positioning recess, and the second assembly ramp may be provided with a positioning boss structurally corresponding to the positioning recess, the positioning boss may be inserted into the positioning recess.

According to one embodiment of the present disclosure, an opening of the positioning recess may be formed with an acute angle and a bottom surface of the positioning recess extends in the horizontal direction.

According to one embodiment of the present disclosure, the flow channel extends slantedly with respect to a horizontal direction, the flow guiding passage may extend with respect to a vertical direction, a lower end of the flow channel may communicate with the fluid chamber, and an upper end of the flow channel may communicate with a lower end of the flow guiding passage.

According to one embodiment of the present disclosure, the flow channel assembly may further comprise a fluid chamber seal disposed in the fluid chamber and located at an upper end of the fluid chamber to close the upper end of the fluid chamber, the fluid chamber seal being provided with an inner hole extending therethrough in an axial direction thereof, and the movable member extending through the inner hole into the fluid chamber.

According to one embodiment of the present disclosure, the upper end of the fluid chamber may be formed in a stepped shape, and the fluid chamber seal may comprise: an outer cylinder having a shape corresponding to a shape of the upper end of the fluid chamber to be fitted at the upper end of the fluid chamber; and an inner cylinder having a radial dimension smaller than a radial dimension of the outer cylinder, the inner cylinder being disposed in the outer cylinder and elastically connected to the outer cylinder, the inner cylinder being provided with the inner hole therein that penetrates it in an axial direction thereof.

According to one embodiment of the present disclosure, the inner cylinder and the outer cylinder may be connected by a Bending elbow member.

According to one embodiment of the present disclosure, the flow channel assembly may further comprise a sealing seat disposed on the fluid seat between the fluid chamber seal and the nozzle, the sealing seat being provided with a guiding passage penetrating in an axial direction thereof, the nozzle and the sealing seat may be connected and in communication with the guide passage, and the movable member passes through the guide passage and may be movable along the axial direction of the guide passage to open and close the nozzle.

According to one embodiment of the present disclosure, a cross section of the guiding passage may be formed as a flower-shaped cross section.

According to one embodiment of the present disclosure, a bottom of the sealing seat may be provided with a positioning step, the nozzle may be provided with a positioning protrusion corresponding to the positioning step, and the positioning protrusion may be embedded in the positioning step.

According to one embodiment of the present disclosure, the nozzle may define an injection passage therein that penetrates along an up-down direction, and an upper end of the injection passage may be formed as a tapered surface fitting with a lower end surface of the movable member.

According to one embodiment of the present disclosure, a lower end of the injection passage may be provided with micro-holes.

According to one embodiment of the present disclosure, a lower end of the nozzle may be provided with a tapered boss, and the micro-holes may be provided in the tapered boss.

According to one embodiment of the present disclosure, the flow channel assembly may further comprise a threaded sleeve, the nozzle and the sealing seat may be mounted on the fluid seat by the threaded sleeve.

A fluid micro-injecting device according to an embodiment of the second aspect of the present disclosure may include the flow channel assembly of the fluid micro-injecting device according to the above embodiment.

The additional aspects and advantages of the present disclosure will be set forth and apparent in part in the following description or be learned by practicing the present disclosure.

BRIEF DESCRIPTION OF THE DRAWINGS

The above and/or additional aspects and advantages of the present disclosure will become apparent and readily understood from the following attached drawings, wherein.

DRAWING REFERENCE SIGNS

Figure 1:
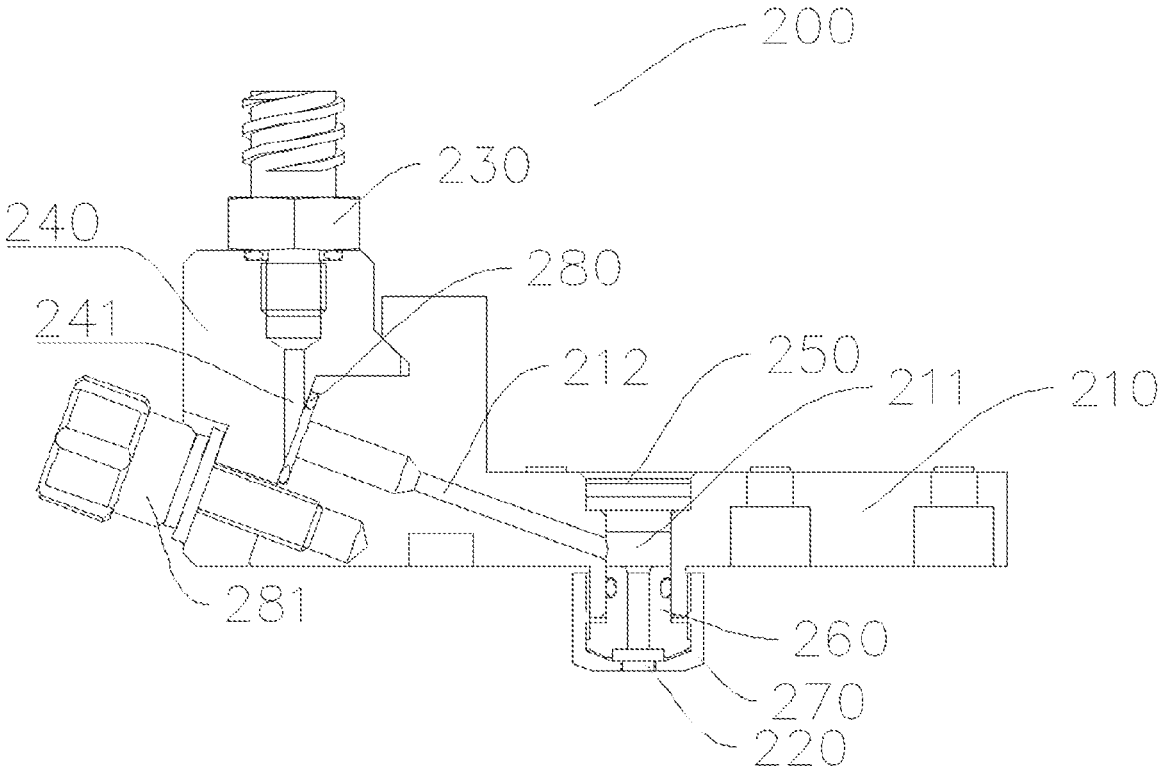
FIG. 1 is a schematic view showing a flow channel assembly of a fluid micro-injection device according to an embodiment of the present disclosure.

Flow channel assembly 200;
Fluid seat 210; Fluid chamber 211; Flow channel 212; First assembly ramp 213;
Positioning recess 214;
Nozzle 220; Positioning protrusion 221; Injection channel 222; Tapered boss 223;
Fluid chamber supply joint 230;
Adapter 240; Flow guiding channel 241; Second assembly ramp 242; Positioning boss 243; U-shaped opening 244;
Fluid chamber seal 250; Inner hole 251; Outer cylinder 252; Inner cylinder 253;
Bending elbow member 254;
Sealing seat 260; Guiding passage 261; Positioning step 262;
Threaded sleeve 270; Internal thread 271; Inner mounting plane 272; flower-shaped notches 273;
Sealing ring 280; Screw 281.

DETAILED DESCRIPTION OF THE DRAWINGS

Embodiments of the present disclosure will be described hereinafter in detail. Examples of the embodiments may be illustrated in the drawings, wherein the same or similar reference numerals refer to the same or similar elements or elements having the same or similar functions. The embodiments described below with reference to the accompanying drawings may be illustrative to explain the present disclosure and should not be construed as being limited to the present disclosure.

In the description of the present disclosure, it should be understood that terms "center", "longitudinal", "transverse", "length", "width", "thickness", "upper", "lower", "front", "back", "left", "right", "vertical", "horizontal", "top", "bottom", "inside", "outside", "clockwise", "counterclockwise", "axial", "radial", "circumferential" and the like refer to orientation and positional relationship based on the orientation or positional relationship shown in the drawings. Those merely intend to describe the present disclosure and simplify description, and do not indicate or imply that the indicated devices or components must be constructed and operated in a particular orientation. Therefore, the above cannot be construed as being limited to the present disclosure. Furthermore, features defining "first" and "second" may explicitly or implicitly include one or more features. In the description of the present disclosure, "plurality" means two or more, unless otherwise stated.

In the description of the present disclosure, it should be noted that the terms "installation", "attached", and "connected" should be understood widely, and for example, may refer to be fixed or detachable or integrally connected; mechanical or electrical connection; directly connected, or indirectly connected through an intermediate medium, or internal communication of two components, unless otherwise explicitly stated and defined. The specific meaning of the above terms in the present disclosure can be understood in a specific case by those skilled in the art.

According to an embodiment of the present disclosure, a flow channel assembly 200 for a fluid micro-injection device will be specifically described below with reference to the accompanying drawings.

As shown in FIGS. 1-12, the flow channel assembly 200 for a fluid micro-injection device according to an embodiment of the present disclosure may include a fluid seat 210, a nozzle 220, and a fluid chamber supply joint 230.

Specifically, the fluid seat 210 may defines a fluid chamber 211 and a flow channel 212 communicating with the fluid chamber 211. The nozzle 220 may be disposed on the fluid seat 210 and communicate with the fluid chamber 211. A movable member may movably pass through the fluid chamber 211 to open and close the nozzle 220. The fluid chamber supply joint 230 may communicate with the flow channel 212 to supply fluid to the nozzle 220 through the flow channel 212 and the fluid chamber 211.

Figure 2:
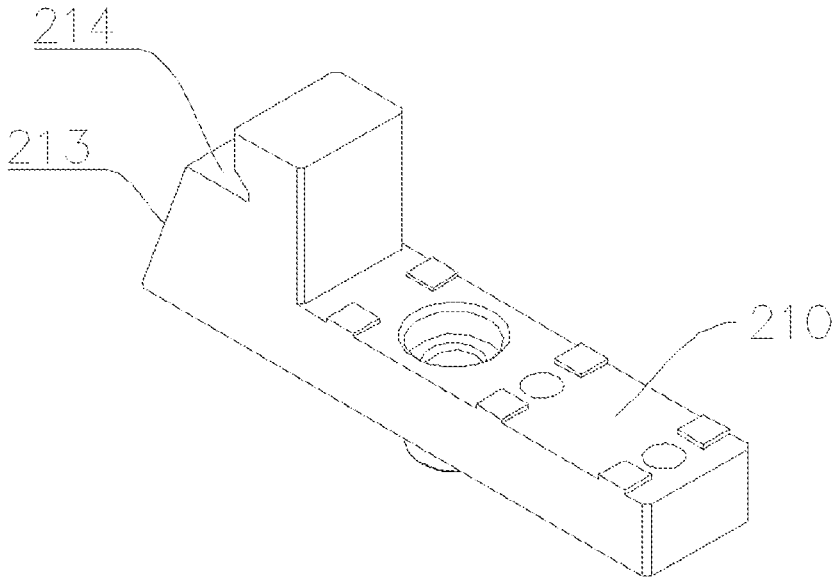
FIG. 2 is a schematic view showing a fluid seat of the flow channel assembly of the fluid micro-injection device according to an embodiment of the present disclosure.

In other words, the flow channel assembly 200 may mainly comprise a fluid seat 210, a nozzle 220 disposed on the fluid seat 210, and a fluid chamber supply joint 230 connected with the fluid seat 210 to provide fluid to the fluid seat 210, as shown in FIGS. 1 and 2. The fluid seat 210 may be provided with a fluid chamber 211 and a flow channel 212. The flow channel 212 may be in communication with the fluid chamber 211. An outlet end of the fluid chamber 211 may be provided with the nozzle 220. The movable member may be movable along an axial direction of the nozzle 220 to open and close the nozzle 220. The fluid chamber supply joint 230 may be disposed on the fluid seat 210 communicating with flow channel 212. The fluid chamber supply joint 230 may be adapted to communicate with a fluid storage device to flow fluid through the flow channel 212 and the fluid chamber 211 to the nozzle.

It should be noted that the fluid micro-injection device according to the embodiment of the present disclosure may comprise an execution system 100 and a flow path assembly. The execution system 100 may be mainly used to control operation of the movable member.

The flow channel assembly 200 may be provided with a flow channel 212 communicating with a fluid storage structure. The execution system 100 may control opening or closing a nozzle 220 of the flow channel assembly 200 by controlling movable member 120 and the operating displacement when the execution system may cooperate with the flow channel assembly 200, thus the fluid micro-injection device may be opened or closed, or the injecting effect of the fluid micro-injection device may be adjusted accordingly. The fluid seat 210 of the flow channel assembly 200 may be provided with a plurality of fitting holes adapted to be assembled with the execution system. Further, the structure of the execution system may be easily understood or implemented by those skilled in the art and therefore will not be described herein in detail.

Thus, according to the flow channel assembly 200 of the fluid micro-injection device according to the embodiment of the present disclosure, the fluid chamber 211 and the flow channel 212 may be defined in the fluid seat 210. Thus, the nozzle 220 on the fluid chamber 211 may be opened and closed by the movable member. The flow chamber supply joint 230 may communicate with the fluid chamber 211 through the flow channel 212. The flow channel assembly 200 may have a simple structure and be convenient for disassembly and cleaning with low maintenance cost.

According to an embodiment of the present disclosure, the flow channel assembly 200 may further include an adapter 240. The adapter 240 may define a flow guiding passage 241 therein. The adapter 240 may be connected to the fluid seat 210, and the flow guiding passage 241 may be connected to the flow channel 212. The fluid chamber supply joint 230 may be disposed on the adapter 240 and communicate with the flow guiding passage 241.

Specifically, as shown in FIG. 1, the fluid chamber supply joint 230 and the fluid seat 210 may be connected together and communicated to each other via the adapter 240 in the present embodiment. The fluid chamber supply joint 230 may be threadedly connected with the adapter 240 be in communication with the flow guiding passage 241.

According to an embodiment of the present disclosure, a seal ring 280 may be provided between the adapter 240 and the fluid chamber supply joint 230 and between the adapter 240 and the fluid seat 210, respectively. Further, the adapter 240 may be connected with the fluid seat 210 by a screw 281.

That is to say, the fluid chamber supply joint 230 and the adapter 240 may be directly connected by the threaded connection. The adapter 240 and the fluid seat 210 may be connected by the screw 281. A jointing portion of the adapter 240 and the fluid chamber supply joint 230 and a jointing portion of the adapter 240 and the fluid seat 210 may be a sealing ring 280, respectively. A fitting face of the adapter 240 and the fluid chamber supply joint 230 and a fitting face of the adapter 240 and the fluid seat 210 may be provided with a fitting groove suitable for placing the sealing ring 280, respectively. When the components may be matched with each other, the sealing ring 280 may be pressed tight for sealing purpose, thus ensuring overall sealing performance of the flow channel assembly 200. The structure assembly may be achieved by a thread or screw connection, so that assembly complexity can be greatly reduced, and assembly/disassembly and cleaning may be easily achieved whereas ensuring sealing performance.

The adapter 240 may be connected to the fluid seat 210 by a screw 281. After the screw 281 may be removed, the adapter 240 may be removed from the fluid seat 210, and one end of the flow channel 212 may be opened. Further, both the adapter 240 and the fluid chamber supply joint 230 may not have closed flow channel respectively. Accordingly, all parts of the entire flow channel assembly 200 may not have the closed channel. And thus all components may be conveniently cleaned to reduce cleaning difficulty after disassembly. According to an embodiment of the present disclosure, the fluid seat 210 may be provided with a first assembly ramp or slope 213 extending slantedly with respect to the horizontal direction. The adapter 240 may be provided with a second assembly ramp 242 that may fit or match with the first assembly ramp 213. The screw 281 may pass through the adapter 240 and the fluid seat 210 to compress the first assembly ramp 213 and the second assembly ramp 241 tight.

According to an embodiment of the present disclosure, the first assembly ramp 213 may be provided with a positioning recess 214, and the second assembly ramp 242 may be provided with a positioning boss 243 corresponding to the positioning recess 214. The positioning boss 243 may be inserted into the positioning recess 214. Further, the opening of the positioning recess 214 may have an acute angle and a bottom surface of the positioning recess 214 may extend in the horizontal direction.

Figure 3:
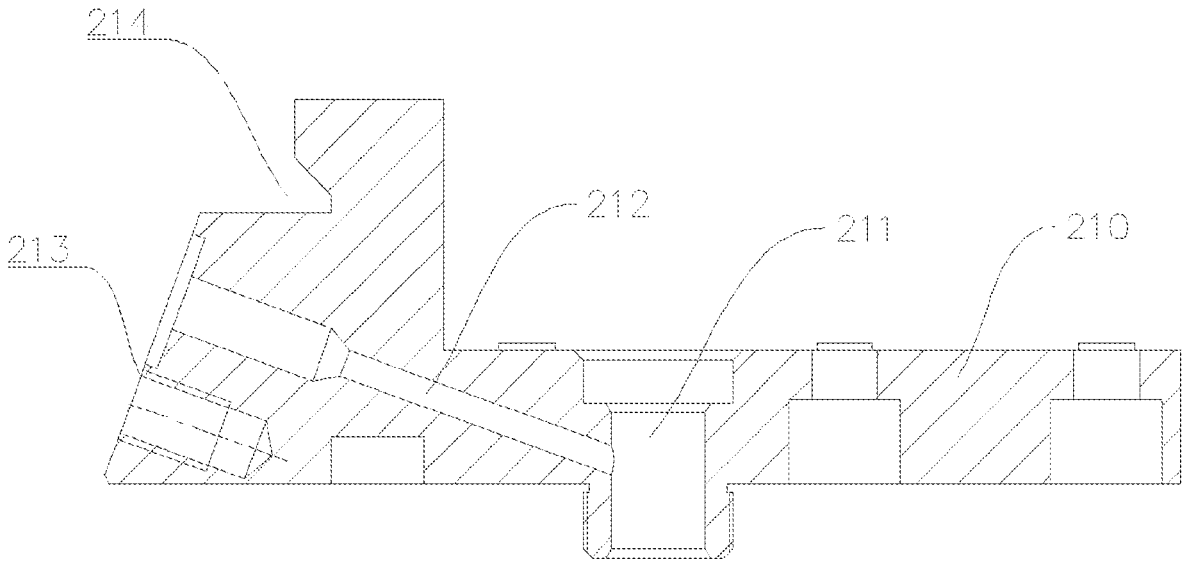
FIG. 3 is a cross-sectional view of a fluid seat of the flow channel assembly of the fluid micro-injection device according to the embodiment of the present disclosure.
Figure 4:
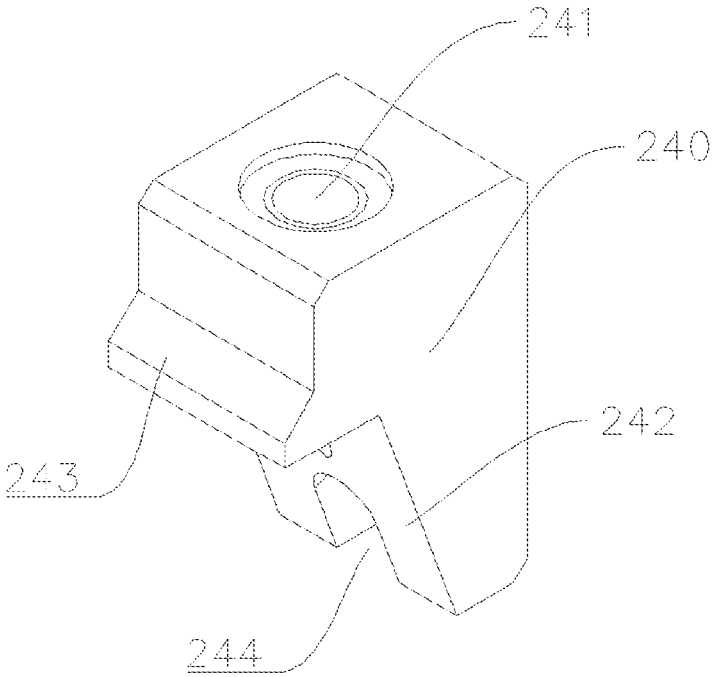
FIG. 4 is a schematic view showing an adapter of the flow channel assembly of the fluid micro-injection device according to an embodiment of the present disclosure.
Figure 5:
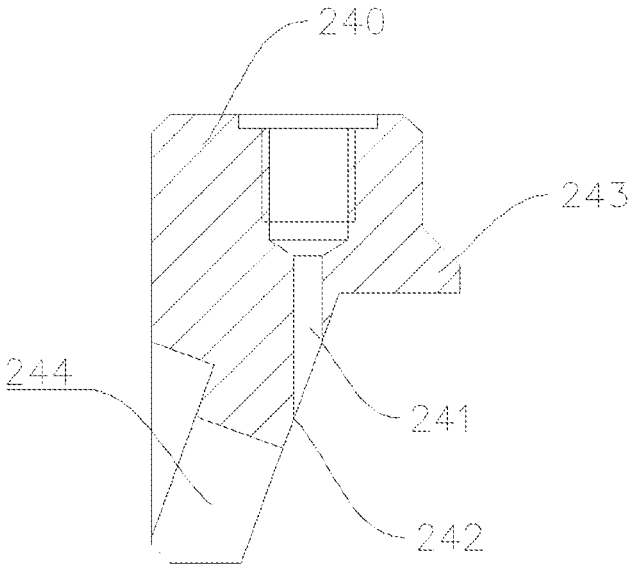
FIG. 5 is a cross-sectional view of an adapter of the flow channel assembly of a fluid micro-injection device according to an embodiment of the present disclosure.

Specifically, the fluid seat 210 and the adapter 240 may be respectively provided with the assembly ramps matching with each other, and the first assembly ramp 213 of the fluid seat 210 may be provided with a positioning recess 214, as shown in FIGS. 1, 3 and 5. The second assembly ramp 242 of the adapter 240 may be provided with the positioning boss 243. During assembly, the adapter 240 may fit with the assembly ramp of the fluid seat 210, and the adapter may be positioned by the matching of the positioning boss 243 and the positioning recess 214. The adapter 240 and the fluid seat 210 may be then fastened by screwing the adapter 240 and the fluid seat 210 via the screw 281, thus achieving the sealing connection of the adapter 240 with the fluid seat 210.

Therefore, when the adapter 240 and the fluid seat 210 may be locked tight, the positioning boss 243 and the positioning recess 214 may automatically guide and position the adapter 240 and the fluid seat 210, so that the mounting surfaces may be closely fitted. Accordingly, and inclination angles of the assembly ramp and the positioning recess 214 may cooperate with each other for matching, thus achieving accurate positioning and assembly.

According to one embodiment of the present disclosure, the flow channel 212 extends slantedly with respect to the horizontal direction. The flow guiding passage 241 may extend along the vertical direction. A lower end of the flow channel 212 may communicate with the fluid chamber 211. An upper end of the flow channel 212 and the lower end of the flow guiding passage 241 may be communicated with each other.

As shown in FIGS. 1 and 2, the flow channel 212 may be formed as a channel joining slantedly. An upper portion of the flow channel 212 may intersect with the flow guiding passage 241 of the adapter 240 and a lower portion of the flow channel 212 may penetrate and intersect with the fluid chamber 211 to achieve fluid delivery. The penetrating and intersecting flow channel 212 and the fluid chamber 211 may be easily cleaned. The flow guiding passage 241 may be formed in a way known in the art, the upper portion of the flow guiding passage 241 may be connected to the fluid supply joint 230 and sealed by pressing and deforming a sealing ring 280. The lower portion of the flow guiding passage may intersect with the upper end of the flow channel 212, and sealed through pressing the sealing ring 280 by pressing the adapter 240 and the fluid seat 210 tight, thereby achieving fluid delivery. Meanwhile, the vertical flow channel may be easy for cleaning.

In addition, the adapter 240 can also be provided with a U-shaped opening 244 adapted to be assembled with the screw 281. The screw 281 may be a quick-locking screw 281. For assembly convenience, the screw 281 may be provided with a flower-shaped cylinder to be convenient for an operator's manual operation. The screw 281 may be provided with an assembly platform adapted to fit with the U-shaped opening 244. When the adapter 240 may be installed, the quick-locking screw 281 may be first screwed into the mounting thread of the fluid seat 210. The U-shaped opening 244 of the adapter 240 may be then inserted between the screw 281 and the fluid seat 210, and the screw 281 may be locked to complete installation. During disassembly, the screw 281 may be firstly loosened, and then the adapter 240 may be directly removed in a slanting manner, thus the disassembly and assembly may be convenient.

According to an embodiment of the present disclosure, the flow channel assembly 200 may further comprise a fluid chamber seal 250 disposed in the fluid chamber 211 and located at an upper end of the fluid chamber 211 to close the upper end of the fluid chamber 211. The fluid chamber seal 250 may be provided with an inner hole 251 penetrating therethrough in an axial direction. The movable member may pass through the inner hole and then extend into the fluid chamber 211.

Figure 6:
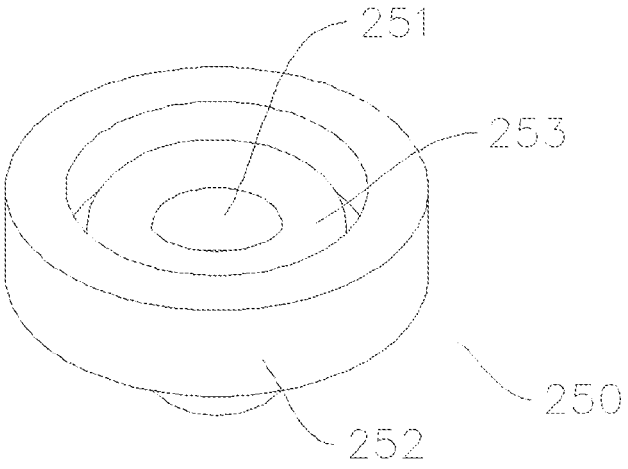
FIG. 6 is a schematic view showing a fluid chamber seal of the flow channel assembly of a fluid micro-injection device according to an embodiment of the present disclosure.
Figure 7:
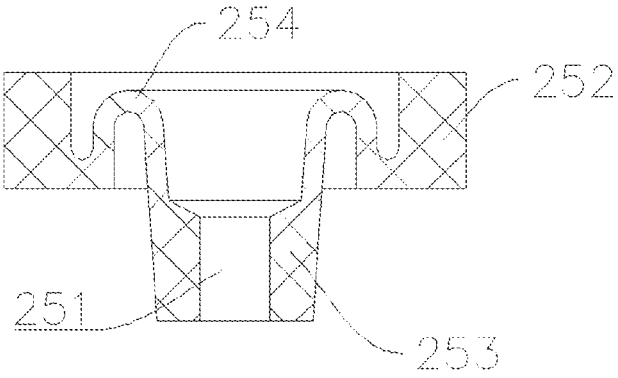
FIG. 7 is a cross-sectional view of a fluid chamber seal of a flow channel assembly of a fluid micro-injection device according to the embodiment of the present disclosure.

Specifically, the fluid chamber seal 250 may be further disposed at the upper end of the fluid chamber 211, as shown in FIGS. 1, 6 and 7. The fluid chamber seal 250 may seal the upper end of the fluid chamber 211, and the fluid chamber seal 250 may be provided with the inner hole 251, through which the movable member can be received. Accordingly, by providing the fluid chamber seal 250, the sealing performance of the fluid chamber 211 may be ensured whereas the movable member may be movably controlled.

Further, according to an embodiment of the present disclosure, the upper end of the fluid chamber 211 may be formed in a stepped shape. The fluid chamber seal 250 may include an outer cylinder 252 and an inner cylinder 253. A shape of the outer cylinder 252 may correspond to that of the upper end of the fluid chamber 211 to be fitted at the upper end of the fluid chamber 211. A radial dimension of the inner cylinder 253 may be smaller than a radial dimension of the outer cylinder 252. The inner cylinder 253 may be disposed in the outer cylinder 252 and elastically connected with the outer cylinder 252. The inner cylinder 253 may be provided with an inner hole 251 along the axial direction thereof. Preferably, the inner cylinder 253 and the outer cylinder 252 may be connected by a bending elbow member 254 in some embodiments of the disclosure.

That is to say, the fluid chamber seal 250 may be mainly comprise two parts, the inner cylinder 253 and the outer cylinder 252. The inner cylinder 253 may be coaxial with the outer cylinder 252. The inner cylinder 253 may be located at inner periphery of the outer cylinder 252. The inner hole 251 may be provided on the inner cylinder 253. The inner cylinder 253 and the outer cylinder 252 may cooperate with each other to form a substantially stepped shape, thus adapting to be fitted with an upper end of the fluid chamber 211.

The inner cylinder 253 and the outer cylinder 252 may be elastically connected or fixedly connected with each other, as long as the movable member may be movable whereas the sealing may be ensured. According to an embodiment of the present disclosure, the inner cylinder 253 and the outer cylinder 252 may be connected by the bending elbow member 254, which may be the bending structure as shown in FIG. 7. Accordingly, the sealing performance of the fluid chamber 211 may be ensured and the movable member may drive the inner cylinder 253 to move in an up and down direction, with a reasonable structure.

According to an embodiment of the present disclosure, the flow channel assembly 200 may further include a sealing seat 260 disposed on the fluid seat 210 between the fluid chamber seal 250 and the nozzle 220. The sealing seat 260 may be provided with a guiding passage 261 extending therethrough in the axial direction. The nozzle 220 may be connected with the seal seat 260 and communicate with the guiding passage 261. The movable member may pass through the guiding passage 261 and movable in the axial direction of the guiding passage 261 to open and close the nozzle 220. Further, a cross section of the guiding passage 261 may be formed as a flower-shaped cross section.

Figure 8:
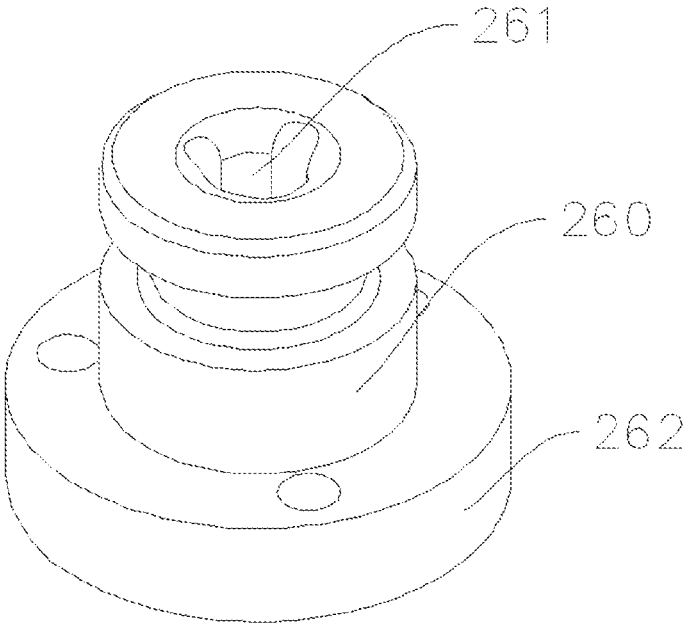
FIG. 8 is a schematic view showing a structure of a sealing seat of a flow channel assembly of a fluid micro-injection device according to an embodiment of the present disclosure.
Figure 9:
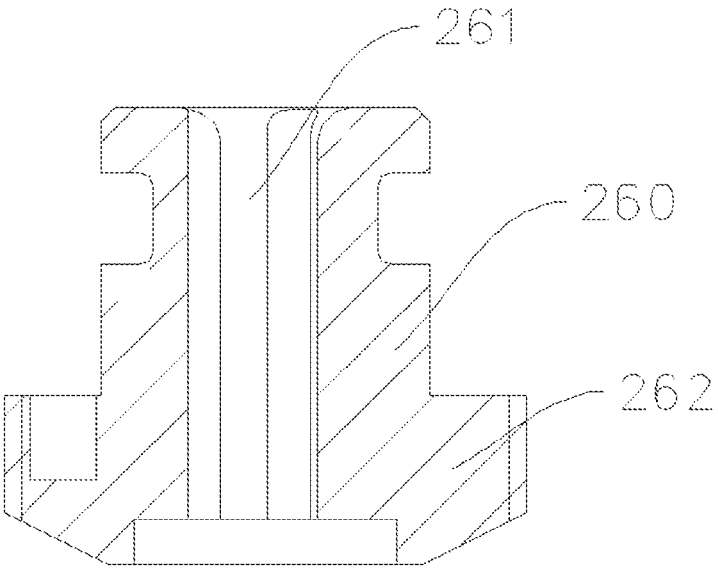
FIG. 9 is a cross-sectional view of the sealing seat of a flow channel assembly of a fluid micro-injection device according to an embodiment of the present disclosure.

Specifically, in this embodiment, the sealing seat 260 may be further disposed in the fluid chamber 211, and the guiding passage 261 may be disposed in the sealing seat 260, as shown in FIGS. 8 and 9. The guiding passage 261 may also achieve fluid delivery while the movable member may be accommodated in the guiding passage and pass therethrough. The cross section of the guiding passage 261 may be formed as a flower-shaped cross section. This means that the guiding passage 261 may comprise the guiding hole penetrating in the axial direction and flower-shaped notches formed on the outer periphery of the guiding hole. When the guiding hole may be engaged with the movable member, the flower-shaped notches on the outer circumference of the guiding hole can ensure that the fluid may reach the junction of the movable member and the nozzle 220, thereby achieving fluid delivery.

According to an embodiment of the present disclosure, a bottom of the sealing seat 260 may be provided with a positioning step 262. The nozzle 220 may be provided with a positioning protrusion 221 corresponding to the positioning step 262. The positioning protrusion 221 may be embedded within the positioning step 262. In view of the above, an interference fit between the nozzle 220 and the sealing seat 260 may be achieved by the matching of the positioning step 262 and the positioning protrusion 221. Accordingly, the sealing performance may be ensured whereas the axis of the nozzle 220 may be coaxial with the axis of the movable member at the same time.

According to an embodiment of the present disclosure, the nozzle 220 may define an injection passage 222 penetrating therethrough. An upper end of the injection passage 222 may be formed as a tapered surface that fits with the lower end surface of the movable member.

Figure 10:
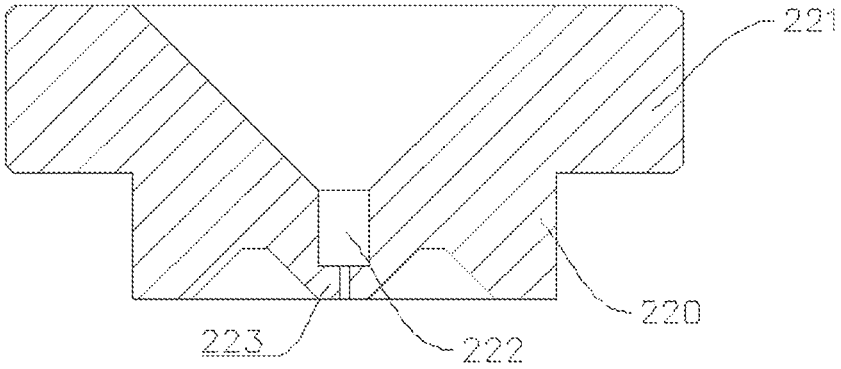
FIG. 10 is a cross-sectional view of a nozzle of a flow channel assembly of a fluid micro-injection device according to an embodiment of the present disclosure.

Specifically, the outer periphery of the upper end of the nozzle 220 may be provided with the positioning protrusion 221 that may fit or match with the sealing seat 260, as shown in FIG. 10. The center of the nozzle 220 may be provided with the injection passage 222 penetrating therethrough in the axial direction. An upper end of the injection passage 222 may be formed as a tapered surface. The lower end of the movable member may be formed as a ball head. When the ball head may abut against the tapered surface of the injection passage 222, the injection passage 222 may be closed accordingly. When the movable member may move upwardly and the ball head may thus be separated from the tapered surface of the injection passage 222, the fluid may be ejected from the injection passage 222. The injection effect of the nozzle 220 for injecting the fluid may be controlled by controlling a distance of the movable member from the injection passage 222.

According to an embodiment of the present disclosure, the lower end of the injection passage 222 may be provided with micro-holes. The micro-holes may be coaxial with the nozzle 220. Dimensions of the micro-holes may be selected according to different injection operating requirements so as to achieve a desired injection effect.

Further, the lower end of the nozzle 220 may be provided with a tapered boss 223 and the micro-holes may be provided in the tapered boss 223 according to one embodiment of the present disclosure. Therefore, rigidity of an outlet of the nozzle 220 may be increased by providing the tapered boss 223 at the outlet of the nozzle 220, thus preventing the end of the nozzle 220 from being damaged in maintenance while reducing fluid congestion at the outlet position, improving fluid coating quality.

According to an embodiment of the present disclosure, the flow channel assembly 200 may further include a threaded sleeve 270. The nozzle 220 and the sealing seat 260 may be mounted on the fluid seat 210 by the threaded sleeve 270.

Figure 11:
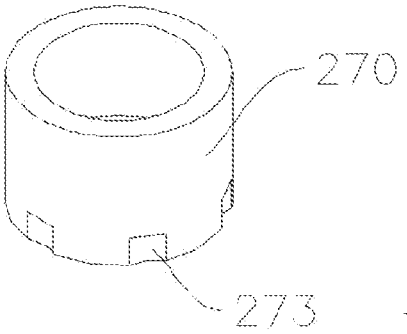
FIG. 11 is a schematic view showing a structure of a threaded sleeve of a flow channel assembly of a fluid micro-injection device according to an embodiment of the present disclosure.
Figure 12:
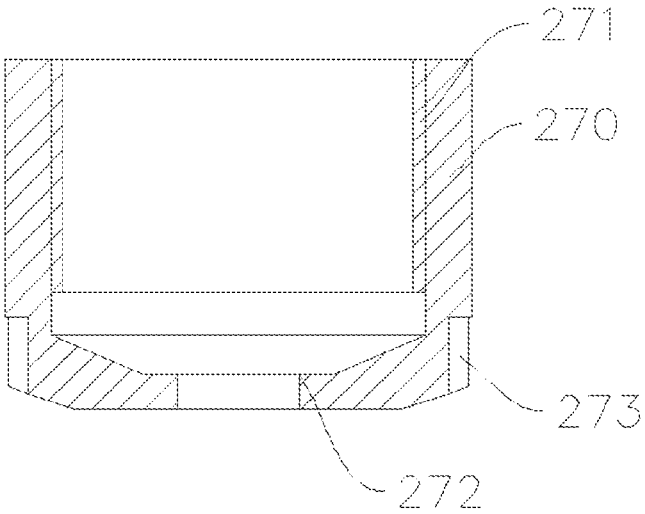
FIG. 12 is a cross-sectional view of a threaded sleeve of the flow channel assembly of a fluid micro-injection device according to an embodiment of the present disclosure.

According to an embodiment of the present disclosure, the threaded sleeve 270 may have an internal thread 271 that may match with the locking thread of the sealing seat 260 to fix the nozzle 220 between the sealing seat 260 and the threaded sleeve 270 when tightened, as shown in FIGS. 11 and 12. The threaded sleeve 270 may be provided with an inner mounting plane 272, which may be perpendicular to an internal thread axis. When the threaded sleeve may be tightened with the sealing seat 260, the inner mounting plane 272 may fit with a lower plane of the nozzle 220 so that the upper surface of the nozzle 220 may be closely fitted to a bottom surface of a round mounting recess of the sealing seat 260, thus achieving a sealing effect.

The lower end of the outer periphery of the threaded sleeve 270 may be provided with the flower-shaped notches 273. The flower-shaped notches 273 may conveniently adjust a position between the nozzle 220 and the movable member by using a matching tool so that the execution system may reach an optimal state for the fluid injecting operation. The flower-shaped notches 273 may be evenly spaced circumferentially, and the notch number may be equal to or greater than two and may be even.

The assembly process and assembly features of the flow channel assembly 200 of the fluid micro-injection device according to an embodiment of the present disclosure may be specifically described below.

Firstly, the sealing ring 280 may be mounted into the upper round recess of the adapter 240. The fluid supply system joint 230 may be then tightened to the adapter 240 to achieve flow channel sealing. Next, the sealing ring 280 may be mounted into the round recess of the inclined surface of the fluid seat 210. The adapter 240 may be connected and locked with the fluid seat 210 by the quick-locking screw 281 in combination with a spring washer and a flat washer to achieve the flow channel sealing. The fluid chamber seal 250 may be then pressed into the stepped fluid chamber 211 of the fluid seat 210 to pre-seal the upper portion of the fluid chamber 211. Finally, the fluid seat seal 250, the nozzle 220 and the seal seat 260 may be assembled together, and the seal seat 260 may be mounted in the threaded sleeve 270. The threaded sleeve 270 may be then threaded into the locking thread of the fluid seat 210 to seal the fluid chamber 211.

The assembly features of components of the flow channel assembly 200 of the fluid micro-injection device may be described as follows:

When the adapter 240 may be assembled with the fluid seat 210, the positioning boss of the adapter 240 may need to be inserted into the positioning recess of the fluid seat 210. The quick-locking screw 281 may be then tightened so that the assembly ramp of the adapter 240 may automatically fit with the assembly ramp of the fluid seat 210, thus achieving sealing effect of the flow channel.

The seal 280 may be inserted into the sealing recess of the sealing seat 260. The nozzle 220 may be then mounted into the round mounting recess of the sealing seat 260, screwed into the threaded sleeve 270 and securely screwed to tighten the nozzle 220. The threaded sleeve 270 may then be screwed into the locking thread of the fluid seat 210 so that the inner tapered surface of the nozzle 220 may be in close contact with the ball head of the movable member. Meanwhile, the fluid seat seal 250 may closely fit with the inner wall of the fluid chamber 211 of the fluid seat 210, thus sealing the fluid chamber 211.

A fluid micro-injection device according to an embodiment of the present disclosure may include the flow channel assembly 200 of the fluid micro-injection device according to the above embodiment(s). The flow channel assembly 200 according to the above embodiment of the present disclosure may have the above-described technical effects etc. Accordingly, the fluid micro-injection to the embodiment of the present disclosure also has a corresponding technical effect, that is, assembly, disassembly and cleaning may be convenient.

In the description of the present specification, the description with reference to the terms "one embodiment", "some embodiments", "illustrative embodiment", "example", "specific example", or "some examples", etc. refer to particular features, structures, materials or characteristics described in the embodiments or examples included in at least one embodiment or example of the present disclosure. In the present specification, the schematic representation of the above terms does not necessarily mean the same embodiment or example. Furthermore, described particular features, structures, materials or characteristics may be combined in a suitable manner in any one or more embodiments or examples.

While the embodiments of the present disclosure have been shown and described, the embodiments of the present disclosure may be changed, varied and replaced for those skilled in the art without departing from the spirit and scope of the present disclosure, whereby the scope of the present disclosure may be defined by the claims and their equivalents.

What is claimed is:

1. A flow channel assembly of a fluid micro-injection device, comprising:

a fluid seat defining a fluid chamber and a flow channel in communication with the fluid chamber therein;

a nozzle disposed on the fluid seat and in communication with the fluid chamber;

a movable member movably passing through the fluid chamber to open and close the nozzle; and a fluid supply joint communicating with the flow channel to provide fluid to the nozzle through the flow channel and the fluid chamber, wherein the flow channel assembly further comprises a fluid chamber seal disposed in the fluid chamber and located at an upper end of the fluid chamber to close the upper end of the fluid chamber, the fluid chamber seal is provided with an inner hole extending therethrough in an axial direction thereof, and the movable member extends through the inner hole into the fluid chamber.

2. The flow channel assembly according to claim 1, further comprising:

an adapter defining a flow guiding passage therein, wherein the adapter is connected to the fluid seat and the flow guiding passage is in communication with the flow channel, and the fluid supply joint is disposed on the adapter and communicates with the flow guiding passage.

3. The flow channel assembly according to claim 2, wherein seal rings are disposed between the adapter and the fluid supply joint and between the adapter and the fluid seat respectively.

4. The flow channel assembly according to claim 2, wherein the adapter and the fluid seat are connected by a screw.

5. The flow channel assembly according to claim 4, wherein the fluid seat is provided with a first assembly ramp extending slantedly with respect to a horizontal direction, and the adapter is provided with a second assembly ramp that fits with the first assembly ramp, the screw passes through the adapter and the fluid seat to compress the first assembly ramp and the second assembly ramp.

6. The flow channel assembly according to claim 5, wherein the first assembly ramp is provided with a positioning recess, and the second assembly ramp is provided with a positioning boss corresponding to the positioning recess, and the positioning boss is inserted into the positioning recess.

7. The flow channel assembly according to claim 6, wherein an opening of the positioning recess is formed with an acute angle and a bottom surface of the positioning recess extends in the horizontal direction.

8. The flow channel assembly according to claim 2, wherein the flow channel extends slantedly with respect to a horizontal direction, the flow guiding passage extends along a vertical direction, a lower end of the flow channel communicates with the fluid chamber, and an upper end of the flow channel communicates with a lower end of the flow guiding passage.

9. A fluid micro-injection device comprising a flow channel assembly according to claim 2.

10. The flow channel assembly according to claim 1, wherein the upper end of the fluid chamber is formed in a stepped shape, and the fluid chamber seal comprises:

an outer cylinder having a shape corresponding to a shape of the upper end of the fluid chamber to be fitted at the upper end of the fluid chamber; and an inner cylinder having a radial dimension smaller than a radial dimension of the outer cylinder, the inner cylinder being disposed in the outer cylinder and elastically connected to the outer cylinder, the inner cylinder being provided with the inner hole that penetrates through the inner cylinder in an axial direction thereof.

11. The flow channel assembly according to claim 10, wherein the inner cylinder and the outer cylinder are connected by a bending elbow member.

12. The flow channel assembly according to claim 1, further comprising:

a sealing seat disposed on the fluid seat between the fluid chamber seal and the nozzle, the sealing seat being provided with a guiding passage penetrating through the sealing seat in an axial direction thereof, the nozzle and the sealing seat are connected and in communication with the guide passage, and the movable member passes through the guide passage and is movable along the axial direction of the guide passage to open and close the nozzle.

13. The flow channel assembly according to claim 12, wherein a cross section of the guiding passage is formed as a flower-shaped cross section.

14. The flow channel assembly according to claim 12, wherein a bottom of the sealing seat is provided with a positioning step, the nozzle is provided with a positioning protrusion corresponding to the positioning step, and the positioning protrusion is embedded in the positioning step.

15. The flow channel assembly according to claim 12, further comprising:

a threaded sleeve, wherein the nozzle and the sealing seat are mounted on the fluid seat by the threaded sleeve.

16. The flow channel assembly according to claim 1, wherein the nozzle defines an injection passage that penetrates along an up-down direction of the injection passage, and an upper end of the injection passage is formed as a tapered surface fitting with a lower end surface of the movable member.

17. The flow channel assembly according to claim 16, wherein a lower end of the injection passage is provided with micro-holes.

18. The flow channel assembly according to claim 17, wherein a lower end of the nozzle is provided with a tapered boss, and the micro-holes are provided in the tapered boss.

19. A fluid micro-injection device comprising a flow channel assembly according to claim 1.

* * * * *